US006598811B2

(12) United States Patent
Boecking

(10) Patent No.: US 6,598,811 B2
(45) Date of Patent: Jul. 29, 2003

(54) PRESSURE CONTROLLED INJECTOR FOR INJECTING FUEL

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/900,965

(22) Filed: Jul. 10, 2001

(65) Prior Publication Data

US 2002/0056761 A1 May 16, 2002

(30) Foreign Application Priority Data

Jul. 10, 2000 (DE) ..... 100 33 428

(51) Int. Cl.[7] ..... F02M 47/02

(52) U.S. Cl. ..... 239/533.8; 239/533.9; 239/533.2; 239/124; 239/126

(58) Field of Search ..... 239/533.2, 533.3, 239/533.4, 533.5, 533.6, 533.7, 533.8, 533.9, 124, 126, 88

(56) References Cited

U.S. PATENT DOCUMENTS

| | | | | | |
|---|---|---|---|---|---|
| 1,977,005 | A | * | 10/1934 | Mock | 239/488 |
| 3,610,529 | A | * | 10/1971 | Huber | 239/124 |
| 5,779,149 | A | * | 7/1998 | Hayes, Jr. | 239/124 |
| 5,803,361 | A | * | 9/1998 | Horiuchi et al. | 239/533.8 |
| 5,873,526 | A | * | 2/1999 | Cooke | 239/533.5 |
| 5,975,428 | A | * | 11/1999 | Potschin et al. | 239/585.1 |
| 6,059,204 | A | * | 5/2000 | Augustin | 239/533.4 |
| 6,296,197 | B1 | * | 10/2001 | Boecking | 123/496 |

* cited by examiner

*Primary Examiner*—Christopher Kim
(74) *Attorney, Agent, or Firm*—Ronald E. Greigg

(57) ABSTRACT

The invention relates to an injector for reservoir (common rail) injection systems for direct-injection internal combustion engines in which a nozzle needle which is surrounded by a nozzle chamber is guided in an injector housing. The inlet of the nozzle chamber is closable and openable via an externally actuatable closing element. From the nozzle inlet, inlets branch off to control parts. The inlets are embodied as throttle elements, one of which is closable on the outlet side via a closing element.

8 Claims, 1 Drawing Sheet

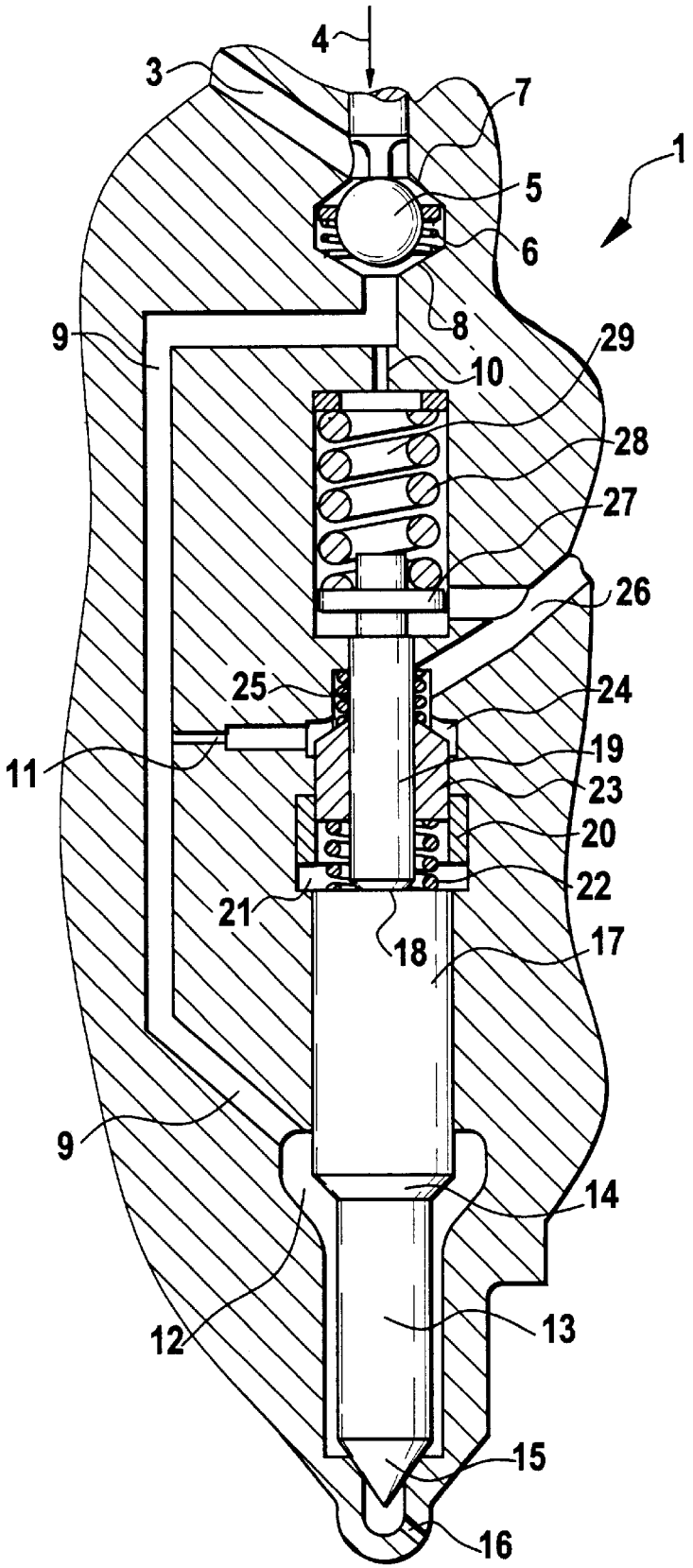
4
3
7
1
5
6
8
9
29
10
28
27
26
25
24
11
19
23
20
22
21
18
17
9
14
12
13
15
16

PRESSURE CONTROLLED INJECTOR FOR INJECTING FUEL

BACKGROUND OF THE INVENTION

FIELD OF THE INVENTION

In direct-injection internal combustion engines, reservoir injection systems (common rail systems) are increasingly being used, and the following demands are made of them: The injection pressure and the injection quantity should be definable independently of one another for every operating point of the direct-injection internal combustion engine, thus affording one additional degree of freedom for mixture formation. In addition, at the onset of injection the injection quantity should be as slight as possible, so that during the ignition delay between the onset of injection and the onset of combustion, not too much fuel will be introduced into the combustion chamber of a direct-injection internal combustion engine. In reservoir (common rail) injection systems with preinjection and main injection and having a modular design, the following components are used: Controlled injectors, which are screwed [in in] into the region of the cylinder head of the engine, pressure reservoir systems, and high-pressure pumps. The injectors communicate with the high-pressure reservoir via short lines and essentially include an injection nozzle and a triggering unit. The injected fuel quantity, for a given pressure, is proportional to the ON time of the actuating unit and is independent of the rpm of the engine and of the pump rpm. The requisite short switching times of the valve actuating units can be attained by designing them appropriately for triggering with high currents and voltages.

DESCRIPTION OF THE PRIOR ART

From German Patent Disclosure DE 198 35 494 A1, a unit fuel injector is known. It serves to deliver fuel to a combustion chamber of direct-injection internal combustion engines with a pump unit for building up an injection pressure and for injecting the fuel via an injection nozzle into the combustion chamber. A control unit with a control valve is also included; the control valve is embodied as an outward-opening A-valve. A valve actuating unit is provided for controlling the pressure buildup in the pump unit. To create a unit fuel injector with a control unit that has a simple design, is small in size, and especially has a short response time, this reference proposes that the valve actuating unit be embodied as a piezoelectric actuator.

From German Patent DE 37 28 817 C2, a fuel injection pump for an internal combustion engine is known. A control valve member comprises a valve shaft, which forms a guide sleeve and slides in a conduit, and a valve head connected to it and oriented toward the actuating device. The sealing face of the valve head is embodied to cooperate with the face of the control bore that forms the valve seat. The valve shaft, on its circumference, has a recess whose axial length extends from the discharge point of the fuel delivery line to the beginning of the sealing face on the valve head that cooperates with the valve seat. A face subjected to the pressure of the fuel delivery line is embodied in the recess and is equal in size to a face of the valve head that in the closed state of the control valve is exposed to the pressure of the fuel delivery line. As a result, in the closed state the valve is pressure-equalized, and a spring urging the control valve toward its open position is received in the guide sleeve.

It has been found that in injector designs that are used in reservoir (common rail) injection systems and that execute nozzle needle strokes of only a few tenths of a millimeter, throttle bores cannot be cleanly closed at such short strokes. As a result, unwanted leaks occur in the vertical motion of a control part in an injector housing and adversely affect the efficiency of an injector used in reservoir injection systems.

SUMMARY OF THE INVENTION

With the design proposed according to this invention, an injector for injecting fuel at high pressure into the combustion chambers of a direct-injection internal combustion engine, it is possible to use a 2/2-way valve instead of a 3/2-way valve. The incident leakage losses are significantly reduced by splitting the closing or relief throttle into two throttle elements. The reduction in leakage during the injection is achieved by closing the inlet of the second throttle element into the leaking oil line by means of a valve ring on a valve bolt. The valve ring can be embodied as a component surrounding a control part piston and including a plane end face and a conical end face. Both faces are acted upon via spring elements, which can be embodied as spiral springs. The spiral springs can be disposed in hollow chambers inside the injector housing. When the valve ring is moved into an annular chamber in the injector housing, the conical end face of the valve ring closes off the second throttle element from the leaking oil line. As a result, reduced leakage can be attained, which favorably affects the efficiency of the injector.

As the nozzle needle moves upward to enable the injection of the fuel into the combustion chambers of a direct-injection internal combustion engine during the injection phase, the second throttle element is closed off on the outlet side, so that the pressure from the high-pressure collection chamber (common rail), which prevails in the nozzle inlet, is maximally maintained. Thus the injection pressure course and the injection pressure level can be adhered to as calculated in advance, so that an injection pressure course corresponding to the course of combustion can be achieved.

The term "injection pressure course" means the varying fuel flow rate during one injection cycle, from the onset to the end of an injection. The course of injection determines the fuel mass pumped during the injection delay between the onset of injection and the onset of combustion. It affects the distribution of fuel in the combustion chamber and thus the air utilization upon combustion in the cylinder of a direct-injection internal combustion engine. The course of injection must rise slowly, so that as little fuel as possible will be injected during the ignition delay. With the onset of combustion, that is, after the development of a complete flame front, this fuel burns fiercely; a term also used is premixed combustion, which adversely affects noise production and $NO_x$ emissions. At the end of combustion, the course of injection must drop off sharply, to prevent poorly atomized fuel in the final phase from causing major emissions of hydrocarbons and soot build up, as well as increased fuel consumption in the direct-injection internal combustion engine.

BRIEF DESCRIPTION OF THE DRAWING

The invention will be described in further detail below in conjunction with the sole drawing FIGURE which shows a longitudinal section through an injector configured according to the invention, whose nozzle needle can be acted upon by a control part piston which in turn is surrounded by a valve ring that closes off a second throttle element.

DESCRIPTION OF THE PREFERRED EMBODIMENT

The injector 1 shown in the FIGURE for injecting fuel which is at high pressure into the combustion chambers of a direct-injection internal combustion engine includes an injector housing 2. An inlet 3 arriving from the high-pressure collection chamber (common rail) is let into the injector housing. The discharge point of the inlet 3 from the high-pressure collection chamber is above a spherically embodied closing element 5, although it could have a shape other than spherical, which is actuatable via a final control element, whether it is a piezoelectric actuator, an electromagnet, or a hydraulic/mechanical booster. The final control element 4 is designed to be externally actuated.

The closing element 5 is surrounded by a disklike ring, on which a sealing spring 6 is based. The space surrounding the closing element 5 is equipped with two sealing seat faces 7 and 8, against which the closing element 5 can alternatively be positioned. If the closing element 5 is placed against the upper seat 7, then the inlet 3, arriving from the high-pressure collection chamber, is closed off from the nozzle inlet 9.

From the nozzle inlet 9, which discharges into a nozzle chamber 12 that surrounds a nozzle needle 13, two throttle elements 10 and 11 branch off. The first throttle element 10 discharges into the hollow chamber 29 provided in the injector housing, in which chamber a sealing spring 28 is received. The sealing spring 28 is braced on one side by a boundary front of the hollow chamber 29 of the injector housing 2 and by the opposite end on a platelike element 27, which is attached to a control part bolt 19. From the hollow chamber 29, a first branch extends into an outlet line 26, which discharges into the tank of the motor vehicle.

From the nozzle inlet 9, a further throttle element 11 extends into an annular chamber 24, embodied in the injector housing 2 and extending annularly around a valve ring 23. The control part bolt 19 is surrounded by the valve ring 23, which includes a plane annular end face on its lower end and its upper region is equipped with an upper end face region which is chambered to form a conical surface. The end face of the valve ring 23 is acted upon by a spring element 22, which is braced on one end against the lower end face of the valve ring 23 and on the other end it rests on the end face of a pressure piece 17 on the nozzle needle 13. The top side, that is the conically chambered region, of the valve ring 23 is acted upon via a spring 25, which is braced on an annularly embodied face of the injector housing 2.

The spring element 22, which rests on the lower end face of the valve ring 23, is in turn surrounded by a stop ring 20 received in a hollow chamber 21. The stop ring 20 serves as a stop face for limiting the pressure piece 17 of the nozzle needle 13. Upon opening of the nozzle needle 13, and enabling of the injection at the injection port 16, the end face of the pressure piece 17 is positioned against the stop ring 20. Thus the spring element 22, is pressed against the lowest end face of valve ring 23, which is supported displaceably on the control part bolt 19 and which in turn moves into the annular chamber 24 in the injector housing 2 and closes the second outlet to the leaking oil line 26. Thus, the second throttle element 11 in the nozzle inlet 9 is sealed off from a direct short circuit to the leaking oil line 26 through the annular chamber 24.

The mode of operation of the injector proposed according to the invention is as follows: Upon actuation of the valve actuating unit 4, which may be a piezoelectric actuator, electromagnet, or hydraulic/mechanical final control element, the inlet 3 from the high-pressure collection chamber (common rail) to the nozzle inlet is opened. Depending on the dimensioning of the sealing spring 6 that acts on the closing element 5, which element as designed here is spherical, a fuel flow rate is established in the nozzle inlet 9 into the nozzle chamber 12. Inside the nozzle chamber 12, by application of the pressure in the nozzle inlet 9 from the high-pressure collection chamber, the nozzle needle 13 and pressure piece 17 are opened. As a result, by vertical upward motion of the nozzle tip 15 out of its seat face, the injection port 16 is uncovered, and a metered quantity of fuel which is at high pressure can be injected into the combustion chamber of a direct-injection internal combustion engine. When the nozzle needle 13 or the pressure piece 17 moves upward as a result of pressure exerted on the pressure shoulder 14 in the nozzle chamber 12, the end face of the pressure piece 17 moves into the hollow chamber 21 in the injector housing 2, far enough that the end face rests on the stop ring 20. As a result, the control part bolt 19 likewise moves vertically upward. By the upward vertical motion of the control part bolt 19, the sealing spring 28 in the hollow chamber 29 inside the injector housing 2 is compressed, since the spring plate 27 connected to the control part bolt 19 also moves vertically upward into the valve chamber 29. The valve chamber 29 is acted upon in turn, via the first throttle element 10, with the fuel at high pressure located in the nozzle inlet 9, and this fuel is likewise present in the hollow chamber 29 in the injector housing 2. The fuel at high pressure reinforces the action of the sealing spring 28 on the plate element 27 of the control part bolt 19.

Upon upward motion of the valve ring 23 into the annular hollow chamber 24 in the injector housing 2 due to increased pressure from spring 22, counter to the action of the sealing spring 25, a lower branch of a leaking oil line 26 is closed. This prevents a short circuit between the further throttle element 11, branching off from the nozzle inlet 9, to the leaking oil line 26 via the annular chamber 24, so that an outflow of fuel which is at high pressure directly via such a short circuit into the fuel tank of a motor vehicle can be prevented.

This improves the efficiency of the injector proposed according to the invention considerably. This improvement is attained in that with the stroke of the nozzle needle 13, the valve ring 23 can be moved, which seals off the outlet precisely at the instant when the injection nozzle at the injection port 16 opens out of its seat 15. The vertical upward motion of the nozzle needle 13 and thus also pressure piece 17, which is effected via a pressure shoulder 14 between the nozzle needle 13 and the pressure piece 17, causes the vertical displacement motion of the valve ring 23 that causes the sealing. Upon nozzle closure, that is, when the closing element 5 moves against its upper seat 7 or its lower seat 8, a pressure relief of the nozzle inlet 9 to the nozzle chamber 12 which surrounds the nozzle needle 13 takes place, initially via the throttle element 11.

The high pressure prevailing in the hollow chamber 29 in the injector housing 2, reinforced by the sealing spring 28, causes a downward motion of the spring plate 27, so that the control part bolt 19 and thus the pressure piece 17 and the nozzle needle 13 are pressed into the nozzle needle seat 15, so that the injection port 16 is closed. With the vertically downward motion of the control part bolt 19, the conically embodied face on the valve ring 23 moves out of the annular chamber 24 and allows a pressure relief of the nozzle inlet 9 via the annular chamber 24 into the lower branch of the leaking oil line 26. The downward motion of the nozzle needle 13 is effected as a result of the high pressure, still prevailing in the hollow chamber 29, and the sealing spring 28 received there, on the one hand, and on the other via a pressure relief of the nozzle inlet 9, effected by the further throttle element 11, into the leaking oil line 26 via the annular chamber 24.

Leakage that is merely slight can be attained by splitting up the closing throttle (relief throttle) into two throttle elements, since precisely at the instant of injection, the second throttle element 11 on the downstream side is closed by the upward motion of the valve ring 23 into the annular chamber 24 occurring upon opening of the nozzle needle 13, the communication between the second throttle element 11 and the leaking oil line 26, is closed by upward motion of the valve ring 23. The closing face embodied conically on the valve ring 23 moves into its opposite seat in the injector housing 2 and seals off the annular chamber 24, so that at this instant, that is, during the injection phase, a leakage loss can now occur only via the first throttle element 10, which discharges into the hollow chamber 29 provided on the housing.

The foregoing relates to preferred exemplary embodiment of the invention, it being understood that other variants and embodiments thereof are possible within the spirit and scope of the invention, the latter being defined by the appended claims.

I claim:

1. An injector for injecting fuel into the combustion chambers of an internal combustion engine, the injector comprising a nozzle needle (13), which is guided in an injector housing (2) and surrounded by a nozzle chamber (12), said nozzle chamber (12) having an inlet (9) closable and openable via an externally actuatable, first closing element (5), and inlets (10, 11) to control chambers (24, 29) which inlets (10, 11) branch off from the inlet (9), said inlets (10, 11) being embodied as throttle elements, wherein said control chambers (24, 29) are connected to a leaking oil line (26), and wherein the connection of a selected one of said control chambers (24, 29) to the leaking oil line (26) is closable via a second closing element (23), wherein the second closing element (23) is a valve ring (23) which surrounds a control part portion (19).

2. The injector of claim 1, wherein said externally actuatable, first closing element (5) immovable into an upper seat (7) and a lower seat (8).

3. The injector of claim 1, wherein said nozzle needle (13) includes a pressure piece (17) which includes an end face (18), and the valve ring (23) is prestressed by a spring element (22) which is braced against said end face (18) of the pressure piece (17).

4. The injector of claim 3, wherein said valve ring (23) is surrounded by a stop ring (20), which acts as a stop for the end face (18) of the pressure piece (17).

5. The injector of claim 1, wherein said valve ring (23) is provided in its upper region with a conical chamber, which protrudes into said selected one of the control chambers (24) in the injector housing (2).

6. The injector of claim 5, further comprising a spring element (25) engaging said conical chamber of said valve ring (23).

7. The injector of claim 1, wherein, when said nozzle needle (13) moves upward into said selected one of said control chambers of said injector housing (2), said valve ring (23) closes said one of said throttle elements.

8. The injector of claim 1, further comprising a spring element (28) which effects the closure of the nozzle needle (13) against a seat (15), which spring element (28) is received in the other control chamber (29) of the housing.

* * * * *